US006493940B2

(12) United States Patent
Westerhof et al.

(10) Patent No.: US 6,493,940 B2
(45) Date of Patent: Dec. 17, 2002

(54) SYSTEM AND APPLIANCE FOR PERSONAL BODY CARE

(76) Inventors: Willem A. Westerhof, Voorhuis 69, 9205 BD Drachten (NL); Marinus C. Hansen, Noordzijde 9, 7874 TH Odornerveen (NL); Johannes H. Van Toor, De Parken 26, 9202 LR Drachten (NL)

( * ) Notice: Subject to any disclaimer, the term of this patent is extended or adjusted under 35 U.S.C. 154(b) by 0 days.

(21) Appl. No.: 09/966,438

(22) Filed: Sep. 28, 2001

(65) Prior Publication Data

US 2002/0032964 A1 Mar. 21, 2002

Related U.S. Application Data

(62) Division of application No. 09/066,471, filed on Apr. 27, 1998, now Pat. No. 6,308,413.

(30) Foreign Application Priority Data

Aug. 29, 1996 (EP) ..... 96202400
Jun. 5, 1997 (EP) ..... 97201704

(51) Int. Cl.[7] ..... B26B 21/44

(52) U.S. Cl. ..... 30/41; 417/472; 417/571; 601/125

(58) Field of Search ..... 30/41, 537, 539, 30/541, 535; 137/112; 601/125, 123, 119; 417/341, 571, 472

(56) References Cited

U.S. PATENT DOCUMENTS 2,790,234 A * 4/1957 Goldstein ..... 30/41
5,092,041 A * 3/1992 Podolsky ..... 30/41
5,337,478 A * 8/1994 Cohen et al. ..... 30/41 X
6,308,413 B1 * 10/2001 Westerhof et al. ..... 30/41

* cited by examiner

*Primary Examiner*—Douglas D. Watts
(74) *Attorney, Agent, or Firm*—Ernestine C. Bartlett

(57) ABSTRACT

The system includes an appliance for personal body care, a pump and a holder. The appliance comprises a treatment device for carrying out a body-care treatment under the influence of a fluid. The fluid is held in the holder and can be pumped to an outlet opening by means of the pump. The holder includes a flexible wall, and the pump is detachable from the holder and is detachable from the appliance. This combination of measures makes it possible to adapt the dimensions of the holder to an ergonomic shape of the appliance.

12 Claims, 8 Drawing Sheets

SYSTEM AND APPLIANCE FOR PERSONAL BODY CARE

CROSS REFERENCE TO RELATED APPLICATIONS

This is a divisional of application Ser. No. 09/066,471, filed Apr. 27, 1998 now U.S. Pat. No. 6,308,413.

BACKGROUND OF THE INVENTION

The invention relates to a system for personal body care, comprising a holder which holds a fluid, a pump for pumping the fluid, and an appliance for personal body care, comprising a treatment device for carrying out a body-care treatment under the influence of the fluid.

The invention further relates to an assembly of a holder for holding a fluid and such a pump.

The invention also relates to an appliance for personal body care, comprising a treatment device for carrying out a body-care treatment under the influence of a fluid, which appliance has a space for accommodating a holder and a pump for pumping the fluid from the holder to an outlet opening of the appliance.

Such a system and such an appliance are known from U.S. Pat. No. 5,283,952. The known appliance is a shaver having a holder with a shaving liquid and a pump for pumping the shaving liquid from the holder to a discharge opening of the shaver. The known system comprises a shaver and a cartridge. The cartridge comprises a rigid holder holding a shaving liquid and a pump. By pressing on the holder the shaving liquid can be pumped to an outlet opening near a shaving head of the shaver. By replacing the cartridge the system is provided with a new load of shaving liquid and a new pump. A drawback of the known system is that the holder is comparatively large in relation to the appliance, so that the holder adversely affects the ergonomics of the system.

SUMMARY OF THE INVENTION

It is an object of the invention to provide a system of the type defined in the opening paragraph, which is more attractive for a consumer than the known system. To this end the system in accordance with the invention is characterized in that the holder comprises a flexible wall, and the pump is detachable from the holder and is detachable from the appliance. This combination of measures makes it possible to adapt the dimensions of the holder to an ergonomic shape of the appliance. This will be explained hereinafter.

By making the pump detachable from the holder an empty holder can be replaced by a full holder without the pump having to be replaced. As a result of this, the replacement of a holder becomes substantially cheaper and the dimensions of the holder can be smaller with the same consumption costs as the known system.

Since the holder has a flexible wall and the size of the holder is comparatively small in relation to the appliance the holder can be accommodated more easily in an appliance having an ergonomic shape.

Since the pump is also detachable from the appliance the pump can still be replaced at regular intervals. As a pump is difficult to clean regular replacement is a good method of guaranteeing the hygiene of the system. By selling holders in a package including, for example, five holders and one pump the user can replace the pump at a rate which is five times as low as the rate of replacement of the holders. Thus, the pump is yet replaced at regular intervals without the cost of replacing a pump each time that an empty holder is replaced by a full holder.

The measures in accordance with the invention make it possible to market a personal care system which appeals to the customer owing to the low cost, great hygiene and ease of handling.

An embodiment of the system in accordance with the invention has the characteristic features wherein the pump comprises a suction tube for taking in the fluid, the holder comprises a coupling member having a tubular outlet channel, and the pump and the holder can be coupled by sliding the suction tube into the outlet channel. Owing to these measures the system can readily be assembled by sliding the suction tube into the outlet channel and coupling the holder to the appliance. As a result of this, the user friendliness of the system is further improved.

Another embodiment of the system in accordance with the invention has the characteristic features wherein the appliance has a space for accommodating the pump and the holder, the space is provided with positioning means for positioning the coupling member of the holder, and the pump is retained in the space by means of the coupling member of the holder. Owing to these measures the pump is no longer in its fixed condition when the holder is detached from the appliance. As a result of this, the pump is easy to replace. Preferably, the system is then constructed in such a manner that the pump is detached together with the holder when the latter is detached from the appliance, for example by means of a detachable snap coupling between the pump and the holder. In that case the pump is removed from the space when the holder is detached from the appliance, so that the users can readily take hold of the pump in order to replace it or in order to couple it to another holder.

An embodiment of the system in accordance with the invention is characterized in that the flexible wall comprises a layer of aluminum having a thickness of between 6 and 12 micrometers. Owing to this measure the wall of the holder is flexible enough to adapt to a decreasing content of the holder without the pressure in the holder differing significantly from the pressure in the environment of the holder. At the same time the holder is rigid enough to withstand some force so that the holder can readily be coupled to the pump and a pump-and-holder assembly can readily be slid into an appliance without fluid being expelled from the holder, neither directly nor via the pump.

An embodiment of the system in accordance with the invention is characterized in that the treatment device is adapted to shave off hairs. The invention is particularly advantageous in such a system because such a system should be easy to handle.

An embodiment of the system in accordance with the invention is characterized in that the treatment device comprises a stationary cutter. Such a shaving system is intended for use in combination with a fluid, for which the appliance should be moved over the skin in strokes. By means of the measures in accordance with the invention it is achieved that the system is light in weight and convenient to manipulate so that the appliance can be moved smoothly over the skin.

An embodiment of the system in accordance with the invention is characterized in that the treatment device comprises a movable shaving member and a drive mechanism for driving the shaving member. Owing to the measures in accordance with the invention it is possible to accommodate a holder with a fluid in the appliance as well as to accommodate the drive mechanism in the appliance without the ease of handling of the system being impaired.

An embodiment of the system in accordance with the invention is characterized in that the treatment device is adapted to depilate. Owing to the measures in accordance with the invention it is readily possible to accommodate a holder with a fluid in the appliance as well as to accommodate a treatment device for depilation in the appliance without the ease of handling of the system being impaired.

An embodiment of the appliance in accordance with the invention is characterized in that the treatment device is adapted to massage a human body. Owing to the measures in accordance with the invention it is readily possible to accommodate a holder with a fluid in the appliance as well as to accommodate a treatment device for body massage in the appliance without the ease of handling of the system being impaired.

The appliance in accordance with the invention is characterized in that the appliance comprises a rigid wall portion which is movable with respect to the appliance from a first position to a second position, in which first position the space is accessible to mount and/or remove the holder and the pump, and in which second position the holder and the pump are retained in the space.

Owing to these measures a holder with a flexible wall can readily be replaced without the pressure being exerted on the flexible wall by the user. This substantially reduces the likelihood of fluid leaking from the holder during replacement.

An embodiment of the appliance in accordance with the invention is characterized in that the wall portion comprises positioning means for positioning the holder. As a result of this, the wall portion can serve as a handle for holding the holder during mounting or removal of the pump. Subsequently, the wall portion with holder and pump can be moved to the second position, the holder being blocked in the positioning means and the pump being retained via the holder.

An embodiment of the appliance in accordance with the invention is characterized in that the wall portion is convex. A convex wall portion is convenient to hold and provides room to accommodate the holder at its inner side.

BRIEF DESCRIPTION OF THE DRAWINGS

The invention will now be described in more detail, by way of example, with reference to the drawings, in which.

DETAILED DESCRIPTION OF PREFERRED EMBODIMENTS

Figure 1:
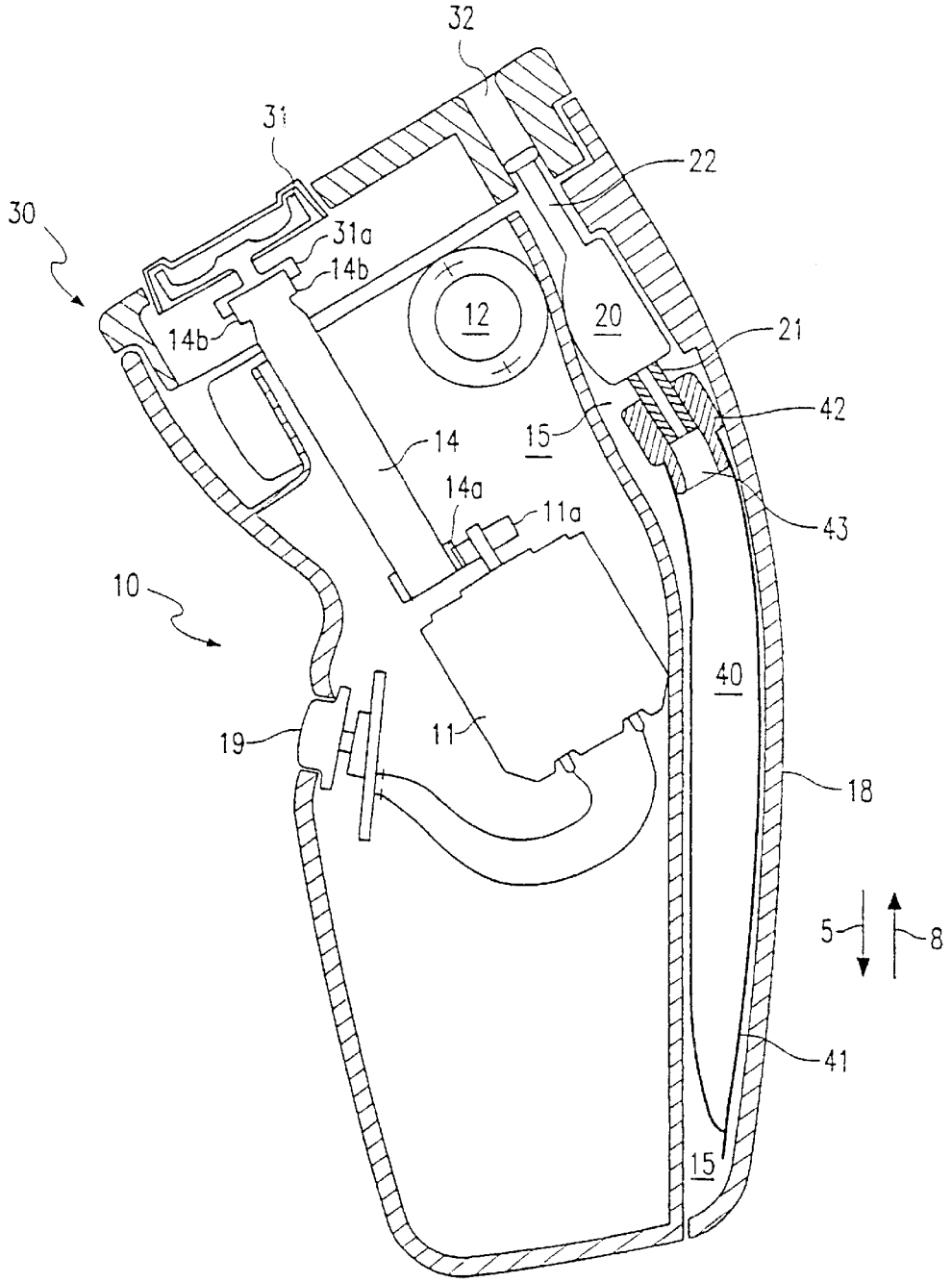
FIG. 1 shows a first embodiment of the system in accordance with the invention.

FIG. 1 shows a first embodiment of the system in accordance with the invention. In this first embodiment the personal care appliance is a shaver 10, comprising a treatment device for carrying out a shaving operation as a body-care treatment under the influence of a fluid.

The treatment device comprises an electric motor 11, which can be switched on by means of a push-button 19 on the outside of the appliance 10. The electric motor 11 carries a pinion 11*a*, which is in mesh with a gear wheel 14*a* which forms part of a coupling pin 14. The coupling pin 14 engages with a part 31*a* of a shaving member in the form of a rotatable cutter 31 by means of a part 14*b*. When the motor 11 is energized the cutter 31 is driven and it is possible, for example, to remove facial hairs. The cutter 31 is adapted for shaving in conjunction with a fluid. The cutter 31 forms part of a shaving head 30 which is moved over the skin of the user during shaving. The fluid serves to reduce the friction between the shaving head 30 and the skin of the user.

The shaver 10 has a space 15 for accommodating a holder 40 holding the fluid and for accommodating a pump 20. The pump 20 serves for pumping the fluid from the holder 43 to an outlet opening 32 of the appliance 10. The appliance 10 has a push-button 12 by means of which the pump 20 can be driven via a drive mechanism, not shown. The holder 40 comprises a coupling member 42 having a tubular outlet channel 43. The holder 43 further comprises a flexible wall 41 welded to the coupling member 42. In the present case the flexible wall consists of a laminate comprising a polyethylene layer of 70 micrometers thickness, an aluminum layer of 9 micrometers thickness and a 12 micrometer PET layer. The polyethylene layer serves to form a sealed connection to the coupling member 42, the aluminum layer serves to obtain an imperforate and slightly rigid wall, and the PET layer serves to protect the aluminum layer and to allow printing. The coupling member 42 of the holder 40 is locked to a wall portion 18 of the appliance 10 via positioning means, in the present case a slot 16 (see FIG. 3). The pump 20 comprises a suction tube 21 slid into the tubular outlet channel 43 of the coupling member 42. Thus, the pump 20 is retained in the space 15 by means of the coupling member 42 and the slot 16.

The wall portion 18 can be removed from the shaver 10 by moving it in the direction 5. Removal of the wall portion 18 from the shaver 10 allows the holder 40 and/or the pump 20 to be replaced.

Figure 2:
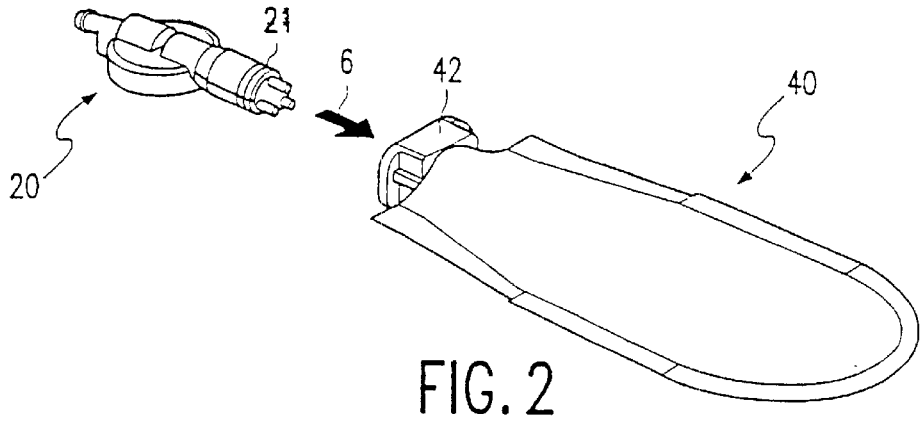
FIG. 2 shows a pump and a holder in the first embodiment, FIG. 3 show an assembly of the pump and the holder shown in FIG. 1, together with a wall portion in the first embodiment of the invention.

FIG. 2 shows the holder 40 and the pump 20 belonging to the first embodiment of the system in accordance with the invention. The pump 20 can be coupled to the holder 40 by sliding the suction tube 21 into the coupling member 42 in the direction 6. The holder 40 is then opened automatically, for example in that a thin wall is perforated or a sealing cap is pressed inward.

Figure 3:
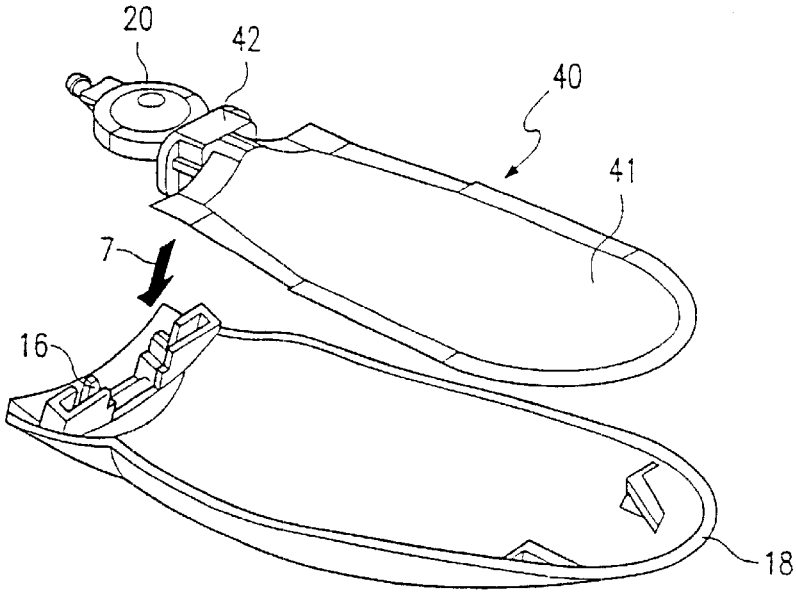

FIG. 3 shows the wall portion 18 and an assembly comprising the pump 20 and the holder 40. The wall portion 18 has a slot 16 adapted to retain the coupling member 42 of the holder 40. When the wall portion 18 has been removed from the shaver 10 the slot 16 is accessible to mount or remove the holder 40. The coupling member 42 can be slid into the slot 16 in a direction 7. Since the direction 7 is oriented transversely to the direction 6 indicated in FIG. 2, the slot 16 can take up the forces exerted on the coupling member by the pump 20 during insertion of the suction tube 21 into the coupling member 42. As a result of this, the wall portion 18 can serve to carry the holder 40 during removal or mounting of the pump 20. The wall portion 18 has a convex shape, so that during mounting or removal of the pump 20 it is easy for the user to avoid that he exerts pressure on the flexible wall 41 of the holder 40. This precludes leakage.

Figure 4:
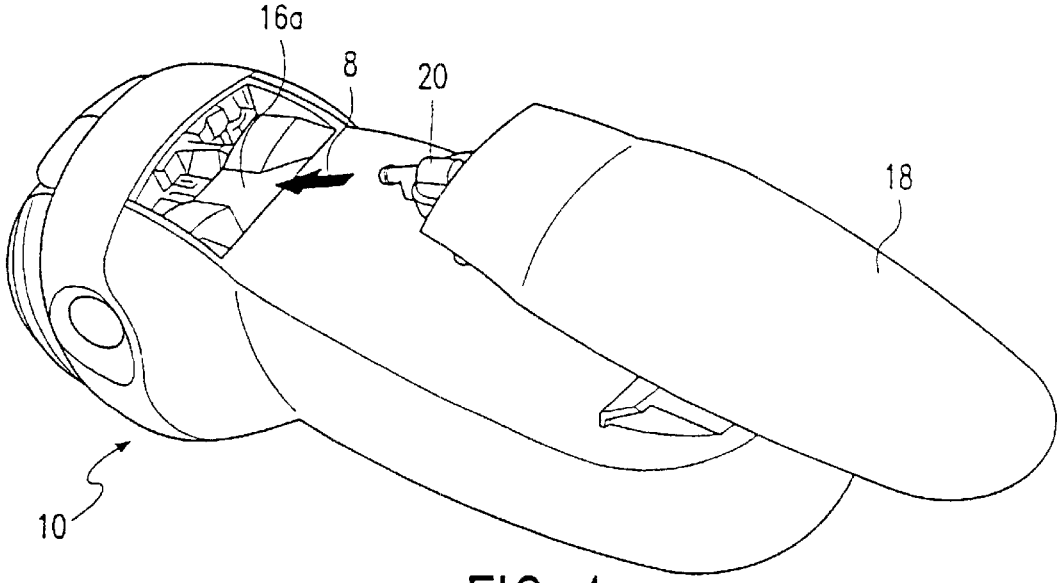
FIG. 4 shows an assembly of the pump, the holder and the wall portion together with an appliance in the first embodiment of the invention.

FIG. 4 shows the appliance 10 and an assembly of the wall portion 18, the pump 20 and the holder 40, not shown. The assembly can be connected to the appliance 10 by sliding it onto the appliance 10 in a direction 8. The outlet channel 22 of the pump 20 is then coupled automatically to the outlet opening 32 of the appliance 10 (see FIG. 1) and the holder 40 is retained in the slot 16 (see FIG. 3) by a wall 16*a* of the appliance 10.

Figure 5:
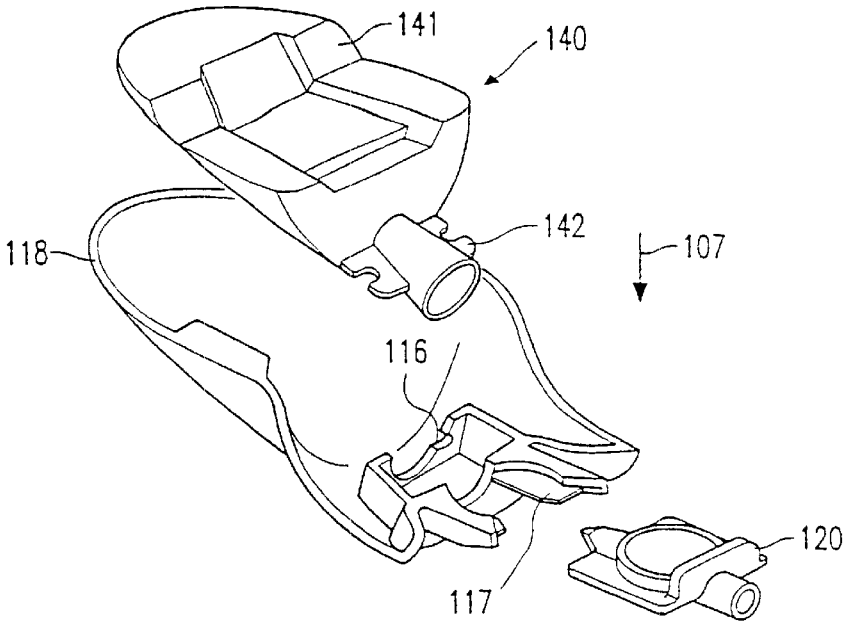
FIG. 5 shows a pump, a holder and a wall portion in a second embodiment of the invention.

FIG. 5 shows a pump, a holder and a wall portion of a second embodiment of the invention. The holder 140 comprises a flexible wall 141 and a comparatively rigid coupling member 142, which have been formed together in a single mold by means of a blow-molding process. The wall portion 118 has a first slot 116 for retaining the holder 140 and a second slot 117 for retaining the pump 120. To assemble the wall portion 118, the holder 140 and the pump 120 the coupling member 142 of the holder 140 should first be fitted into the slot 116 and subsequently the pump 120 should fitted into the slot 117.

Figure 6:
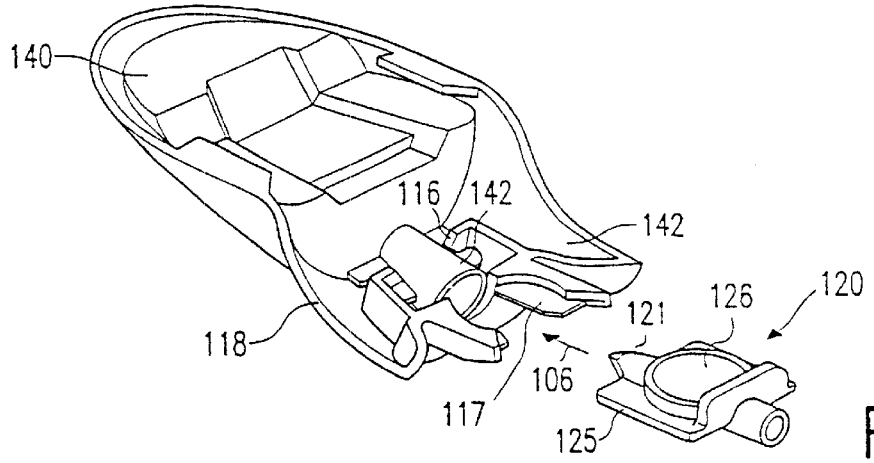
FIG. 6 shows an assembly of the holder and the wall portion together with the pump in the second embodiment.

FIG. 6 shows the situation in which the coupling member 142 of the holder 140 has engaged the slot 116 in the wall portion 118. The pump 120 has a guide 125 with which the pump 120 can be slid into the slot 117 by moving it in a direction 106. A suction tube 121 of the pump 120 then engages in the coupling member 142 of the holder 140. The slot 117 and the pump 120 are of such a construction that the pump 120 can be coupled to the wall portion 118 in only one orientation. This ensures that the diaphragm 126 of the pump 120 can be activated by means of the button 12 as shown in FIG. 1.

Figure 7:
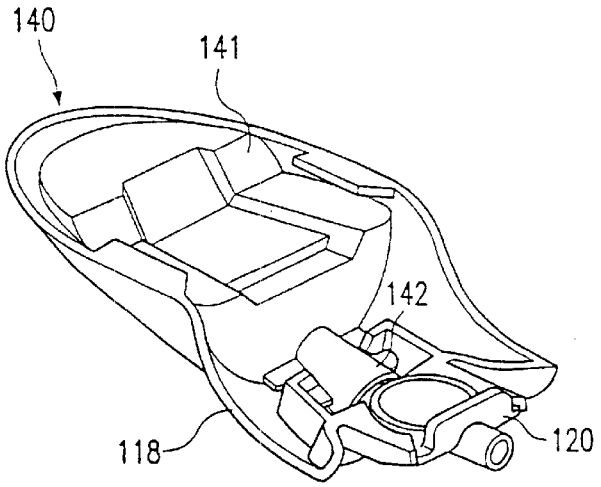
FIG. 7 shows an assembly of the pump, the holder and the wall portion in the second embodiment.

FIG. 7 shows the pump 120, the holder 140 and the wall portion 118 in an assembled condition. In this condition the coupling member 142 is retained in the slot 116 by means of the pump 120 because the mounting direction 107 for the coupling member 142 and the mounting direction 106 for the pump 120 are oriented transversely to one another and the suction tube 121 of the pump 120 engages in the coupling member 142. As a result of this measure, the construction requires that a user should first mount the holder 140 in the wall portion 118 before he can mount the pump 120. This reduces the risk of leakage because the user is unlikely to exert pressure on the flexible wall 141 of the holder during mounting of the pump.

Figure 8:
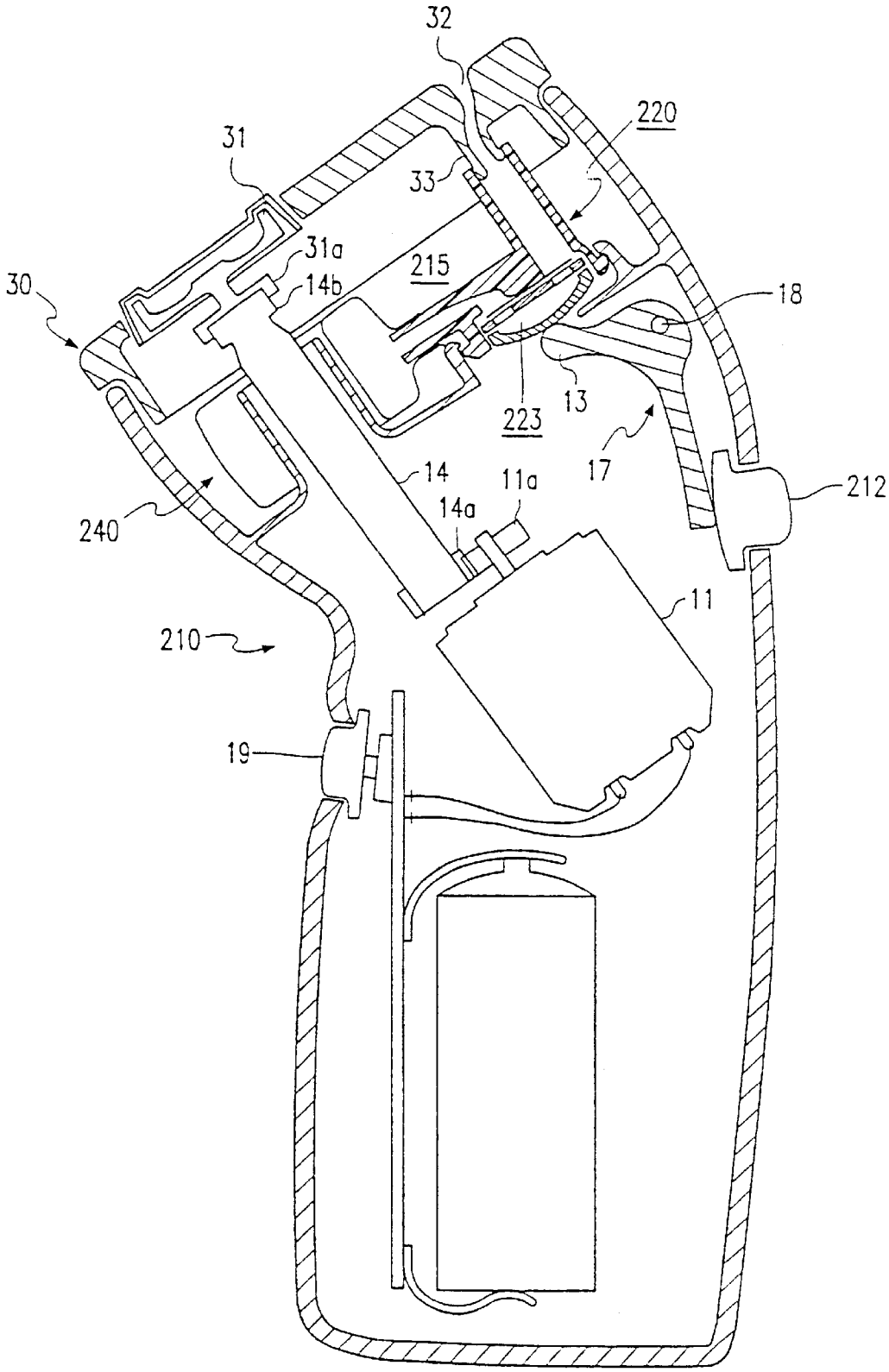
FIG. 8 shows a third embodiment of the system in accordance with the invention.

FIG. 8 shows a third embodiment of the system in accordance with the invention. The system comprises an electric shaver 210, a pump 220 and a holder 240. The shaver 210 comprises a treatment device bearing reference numerals corresponding to those in FIG. 1. The shaver 210 further comprises a chamber 215 adapted to accommodate the holder 240 and the pump 220. The chamber 215 extends between the shaving head 30 and the motor 11. The shaving head 30 is movable with respect to the shaver 210 so as to give access to the chamber 215.

The pump 220 is a diaphragm pump. In order to drive the diaphragm pump 220 the shaver 210 comprises an actuator 13 which terminates in the chamber 215. A mechanism, in the present case a lever 17 which is pivotable about a pivot 18, couples the actuator 13 to a button 15 at the exterior of the shaver 210, in such a manner that the actuator 13 can be driven by moving the button 212. By pressing the button 212 the diaphragm 223 is pressed inward and a small amount of the substance can be applied to the skin of a user via the outlet opening 32.

Figure 9:
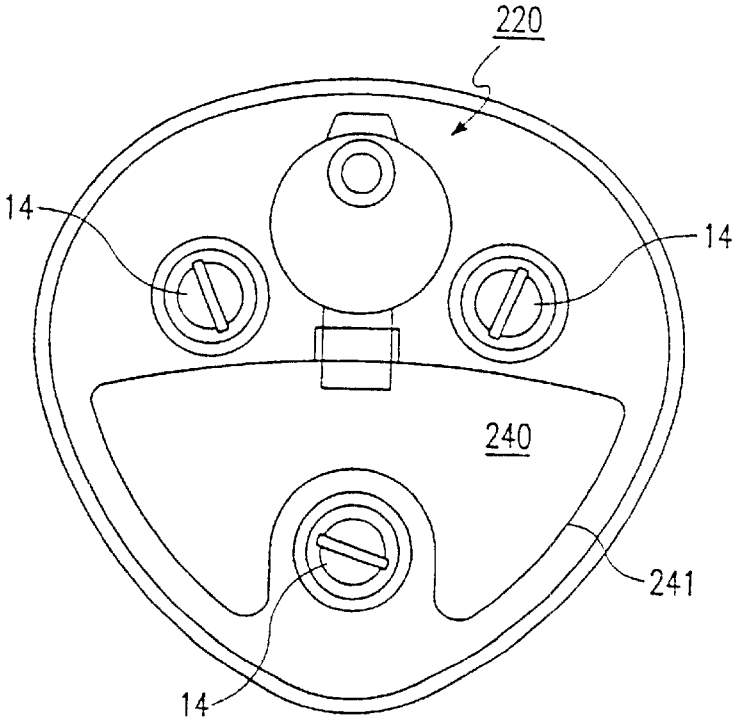
FIG. 9 is a plan view of the third embodiment.

FIG. 9 is a plan view of a chamber 215 which accommodates the pump 220 and the holder 240, the holder 240 comprises a flexible wall 241. Owing to this measure a substantial part of the volume of the chamber 12 can be utilized in spite of the presence of the coupling elements 14. This makes it possible to use the comparatively small chamber 215 to accommodate the holder 240 and the pump 220 and to optimize the shape of the appliance as regards ergonomic and aesthetic aspects.

Figure 10:
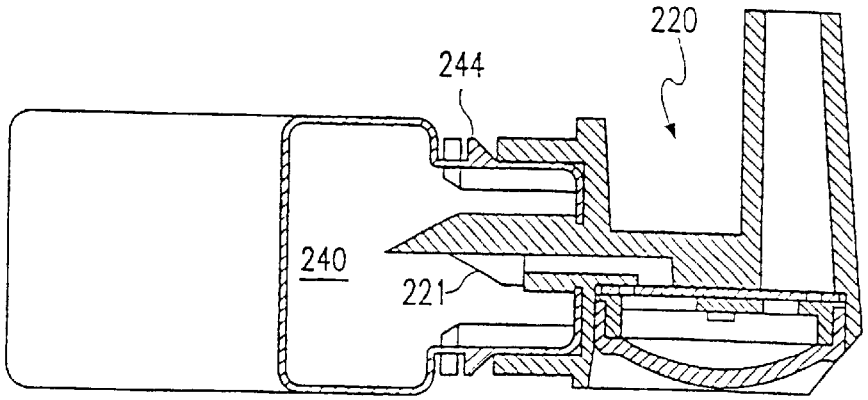
FIG. 10 is a sectional view of an assembly of a holder and a pump in the third embodiment of the invention.

FIG. 10 is a sectional view of an assembly of the holder 240 and the pump 220. The holder 240 has projections 244 for coupling the holder 240 to the pump 220 by means of a detachable bayonet coupling. The pump 220 comprises a hollow needle 221 which perforates the holder 240 when the holder 240 is coupled to the pump 220.

Figure 11:
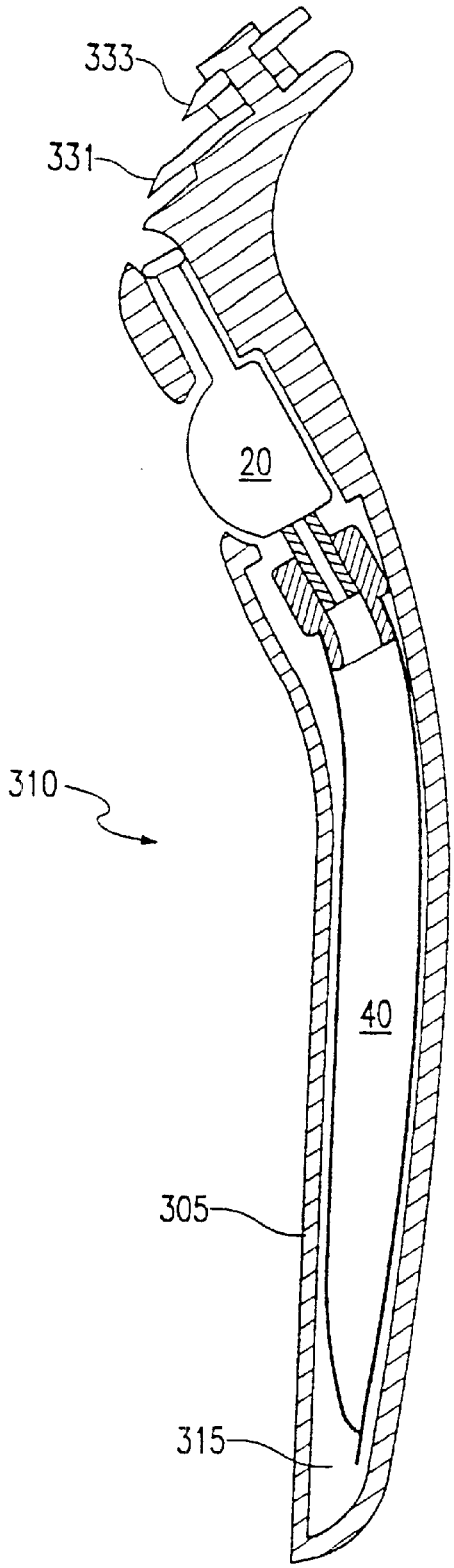
FIG. 11 shows a fourth embodiment of the system in accordance with the invention.

FIG. 11 shows a fourth embodiment of the system in accordance with the invention. The system comprises a shaver 310 comprising a handle 305 and two stationary cutters 331 and 333 for shaving off hairs. The handle 305 has a space 315 which accommodates a holder 40 and a pump 20 as described hereinbefore.

Figure 12:
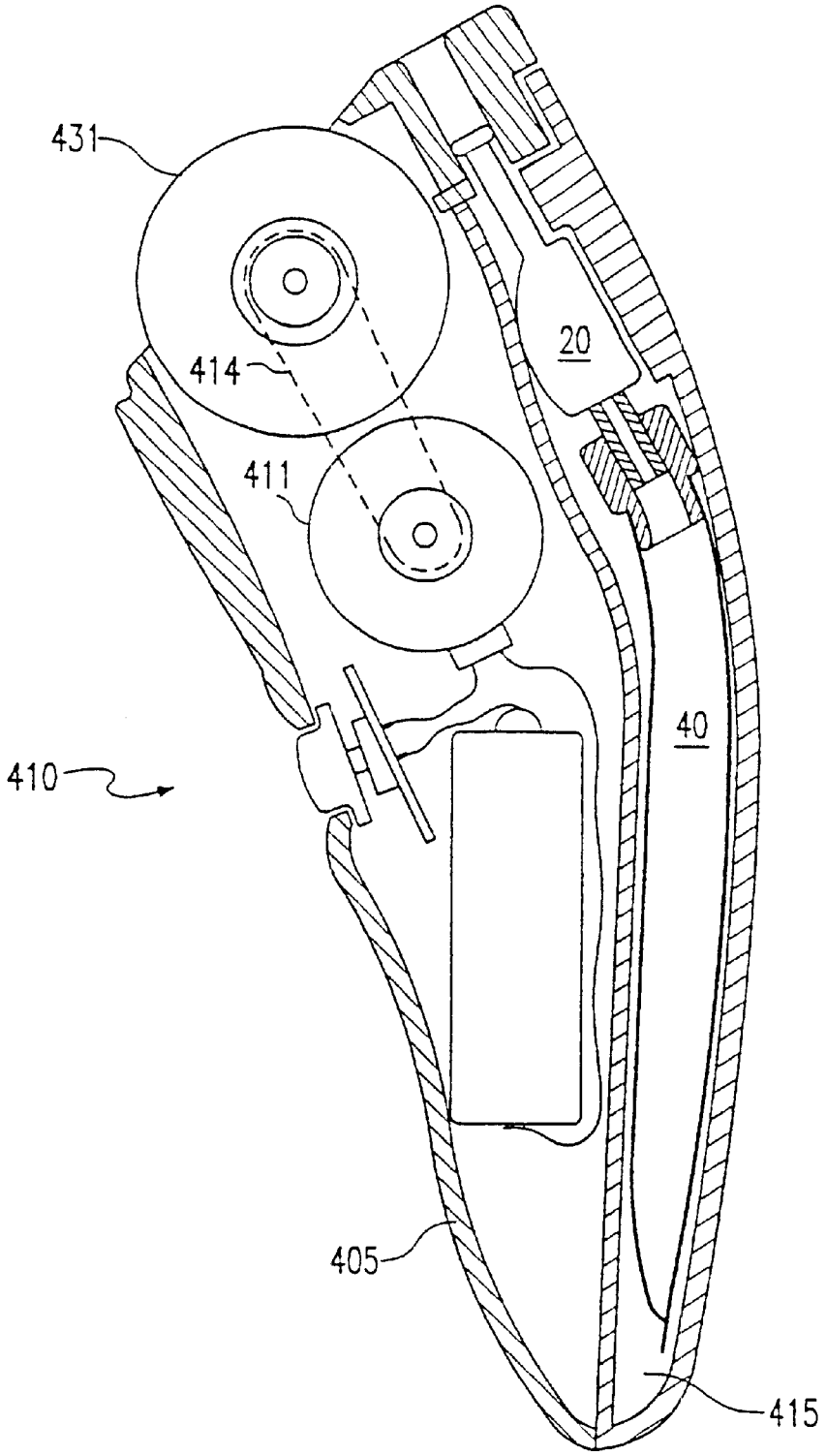
FIG. 12 shows a fifth embodiment of the system in accordance with the invention.

FIG. 12 shows a fifth embodiment of the system in accordance with the invention. The system comprises a depilation appliance 410 having a housing 405, an electric motor 411, a drive belt 414 and a set of depilation discs 431 for the extraction of hairs. The housing 404 has a space 415 which accommodates a holder 40 and a pump 20 as described hereinbefore.

Figure 13:
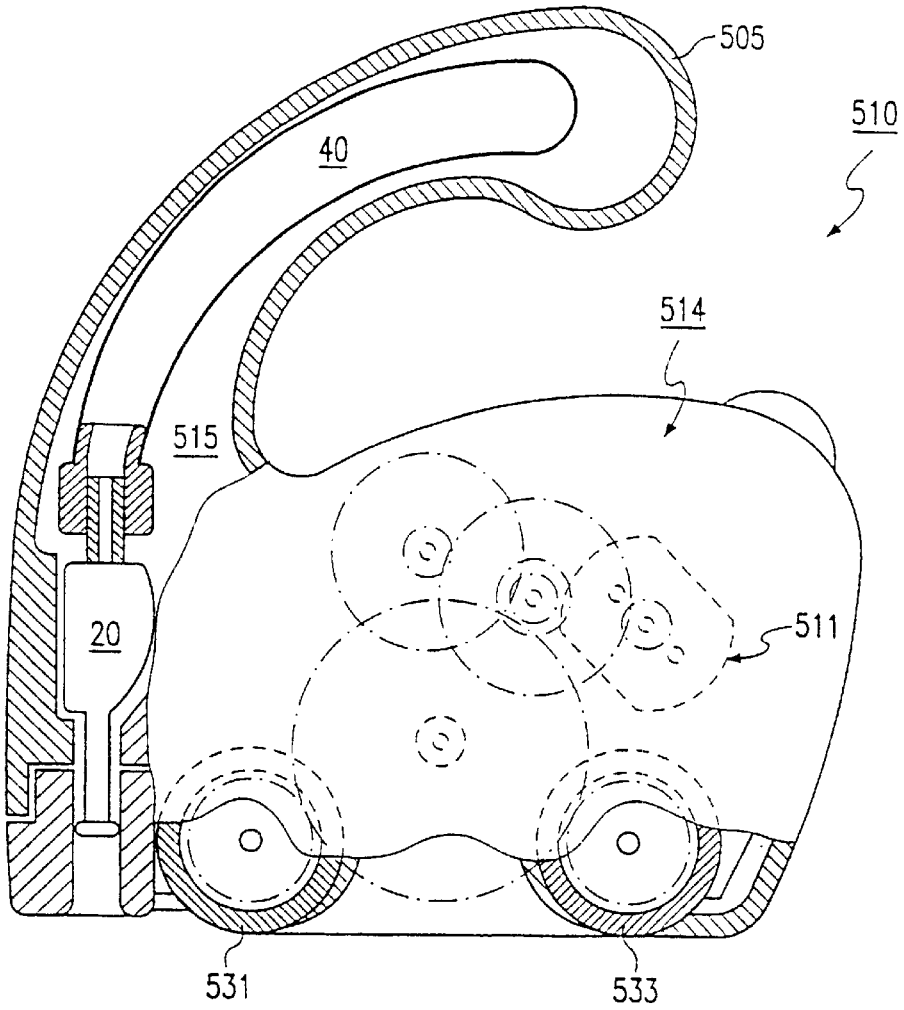
FIG. 13 shows a sixth embodiment of the system in accordance with the invention.

FIG. 13 shows a sixth embodiment of the system in accordance with the invention. The system comprises a massaging appliance 510 having a housing 505, an electric motor 511, a transmission mechanism 514 and two massaging rollers 531 and 533 for massaging the skin of the user. The housing 505 has a space 515 which accommodates a holder 40 and a pump 20 as described hereinbefore.

It is to be noted that the invention is not limited to the embodiments shown herein. Various other embodiments are possible within the scope of the invention. Thus, it is possible to use another type of pump, for example a reciprocating pump. Besides, the appliance can be another appliance for personal body care which carries out a body-care treatment under the influence of a fluid. In such appliances it is always a great advantage if the holder can be flexible and comparatively small so that the provision of a space for accommodating the holder does not affect or hardly affects the ergonomics of the appliance.

What is claimed is:

1. A system for personal body care, comprising:

a holder which holds a fluid, a pump coupled to said holder for pumping the fluid, and an appliance for personal body care, comprising a treatment device operatively associated with said holder and said pump for carrying out a body-care treatment under the influence of the fluid, wherein the treatment device is adapted to depilate, the holder comprises a flexible wall, and the pump is detachable from the holder and is detachable from the appliance.

2. A system for personal body care, comprising:

a holder which holds a fluid, a pump coupled to said holder for pumping the fluid, and an appliance for personal body care, comprising a treatment device operatively associated with said holder and said pump for carrying out a body-care treatment under the influence of the fluid, wherein the treatment device is adapted to massage a human body, the holder comprises a flexible wall, and the pump is detachable from the holder and is detachable from the appliance.

3. A system as claimed in claim 1, wherein the pump comprises a suction tube for taking in the fluid, the holder comprises a coupling member having a tubular outlet channel, and the pump and holder can be coupled by sliding the suction tube into the tubular outlet channel.

4. A system as claimed in claim 1, wherein the appliance has a space for accommodating the pump and the holder, the space is provided with positioning means for positioning a coupling member of the holder, and the pump is retained in the space by means of the coupling member of the holder.

5. A system as claimed in claim 1, wherein the flexible wall of the holder comprises a layer of aluminum having a thickness of between 6 and 12 micrometers.

6. An appliance for personal body care, comprising a treatment device for carrying out a body-care treatment under the influence of a fluid, which appliance has a space for accommodating a holder and a pump for pumping the fluid from the holder to an outlet opening of the appliance, wherein the treatment device is adapted to depilate, the holder comprises a flexible wall, and the pump is detachable from the holder and is detachable from the appliance, and wherein the appliance comprises a rigid wall portion which is movable with respect to the appliance from a first position to a second position, in which first position the space is accessible to mount and/or remove the holder and the pump, and in which second position the holder and the pump are retained in the space.

7. An appliance as claimed in claim 6, wherein the wall portion comprises positioning means for positioning the holder.

8. A system as claimed in claim 2, wherein the pump comprises a suction tube for taking in the fluid, the holder comprises a coupling member having a tubular outlet channel, and the pump and holder can be coupled by sliding the suction tube into the tubular outlet channel.

9. A system as claimed in claim 2, wherein the appliance has a space for accommodating the pump and the holder, the space is provided with positioning means for positioning a coupling member of the holder, and the pump is retained in the space by means of the coupling member of the holder.

10. A system as claimed in claim 2, wherein the flexible wall of the holder comprises a layer of aluminum having a thickness of between 6 and 12 micrometers.

11. An appliance for personal body care, comprising a treatment device for carrying out a body-care treatment under the influence of a fluid, which appliance has a space for accommodating a holder and a pump for pumping the fluid from the holder to an outlet opening of the appliance, wherein the treatment device is adapted to massage a human body, the holder comprises a flexible wall, and the pump is detachable from the holder and is detachable from the appliance, and wherein the appliance comprises a rigid wall portion which is movable with respect to the appliance from a first position to a second position, in which first position the space is accessible to mount and/or remove the holder and the pump, and in which second position the holder and the pump are retained in the space.

12. An appliance as claimed in claim 9, wherein the wall portion comprises positioning means for positioning the holder.

* * * * *